United States Patent [19]

White

[11] Patent Number: 4,921,303

[45] Date of Patent: May 1, 1990

[54] STUDIO STOOL

[76] Inventor: Terrance F. White, P.O. Box 485, Vulcan, Alberta, Canada

[21] Appl. No.: 252,918

[22] Filed: Oct. 4, 1988

[30] Foreign Application Priority Data

May 27, 1988 [CA] Canada ..... 568006

[51] Int. Cl.[5] ..... A47C 5/10

[52] U.S. Cl. ..... 297/338; 297/156; 403/110

[58] Field of Search ..... 297/338, 138, 156, 250, 297/257, 232, 195, 346; 248/420; 403/373, 344, 110

[56] References Cited

U.S. PATENT DOCUMENTS

| | | | |
|---|---|---|---|
| 27,531 | 8/1887 | Badgley . | |
| 550,588 | 12/1895 | Burr . | |
| 981,948 | 1/1911 | Rosenthal | 403/110 X |
| 985,571 | 2/1911 | Cramer | 403/110 X |
| 2,145,505 | 9/1937 | Cahill . | |
| 2,658,553 | 12/1952 | Stewart . | |
| 3,220,771 | 11/1965 | Doss | 297/156 X |
| 3,244,450 | 4/1966 | Boutin | 297/156 |
| 3,322,460 | 5/1967 | Leverman | 297/338 X |
| 3,350,133 | 9/1966 | Schaefer . | |
| 4,542,936 | 9/1985 | Gafken . | |
| 4,793,654 | 12/1988 | Takafuj | 297/338 |

FOREIGN PATENT DOCUMENTS

| | | | |
|---|---|---|---|
| 877094 | 8/1971 | Canada . | |
| 1339670 | 9/1963 | France | 297/338 |

*Primary Examiner*—Laurie K. Cranmer
*Attorney, Agent, or Firm*—Browdy and Neimark

[57] ABSTRACT

A chair structure having at least one seat adjustable in elevation, is disclosed. The structure has particular use as a posing stool for use in a photographic studio or in the field. At least one seat is adjustably secured on an elongated, angularly elevated support member so as to be quickly and slidably located to any selected elevation on that support.

4 Claims, 2 Drawing Sheets

STUDIO STOOL

FIELD OF THE INVENTION

This invention relates to chair structures and in particular to a posing stool for a photographic studio. Adjustable chairs or stools for photographic studios are well known in the art. However, the examples of the prior art of which I am away of are complicated involving numerous parts and methods of adjustment and generally consist of far too many parts to be manufactured to render them economically feasible. Moreover, their size is usually such that they become a permanent, semi-fixed structure in a studio and are very difficult to move about.

SUMMARY OF THE INVENTION

The present invention strides to overcome the prior art problems in this field and has resulted in a stool structure of simple yet effective design that is relatively inexpensive to produce, very effective in function and which is both strong and light so that it can be easily moved about a studio or taken out in the field for outdoor use.

The present invention may utilize a single seat or two or more seats depending on the physical size of the structure. The seat or seats are adjustably secured on an elongated, angularly elevated support member so that the seats can be quickly and slidably located to any selected elevation on that support.

The stool according to the present invention is effective for the posing or seating of a single model or for the posing of a pair of subjects.

The apparatus can be manufactured from light gauge tubing, preferably tubing of square cross-section for added strength and easy alignment of the adjustably locateable seats.

According to a broad aspect, the invention relates to a photographer's studio stool comprising a triangulated support structure including a pair of leg members formed in a generally inverted U-shaped arrangement and an elongated angularly disposed support member constituting a third leg and connected and extending downwardly from the upper portion of said inverted U-shaped arrangement to rest on a supporting surface. At leat one seat is releasably secured on the elongated support member so as to be selectively located at any desired elevation thereon, and means are provided for securing the seat on said support member.

BRIEF DESCRIPTION OF THE DRAWINGS

The invention is illustrated by way of example in the accompanying drawings in which.

DETAILED DESCRIPTION OF THE PREFERRED EMBODIMENT

Figure 1:
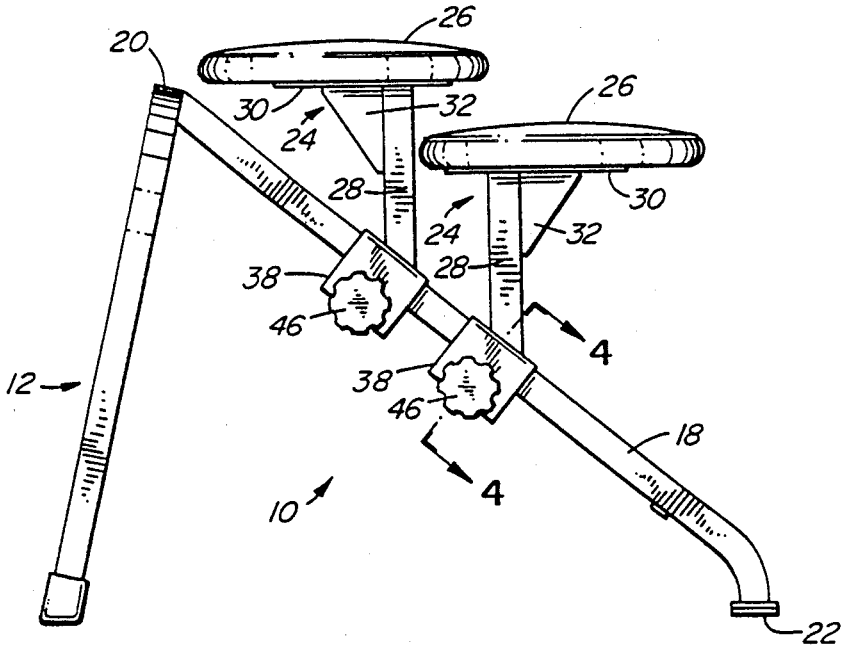
FIG. 1 is a side elevation of the invention.
Figure 2:
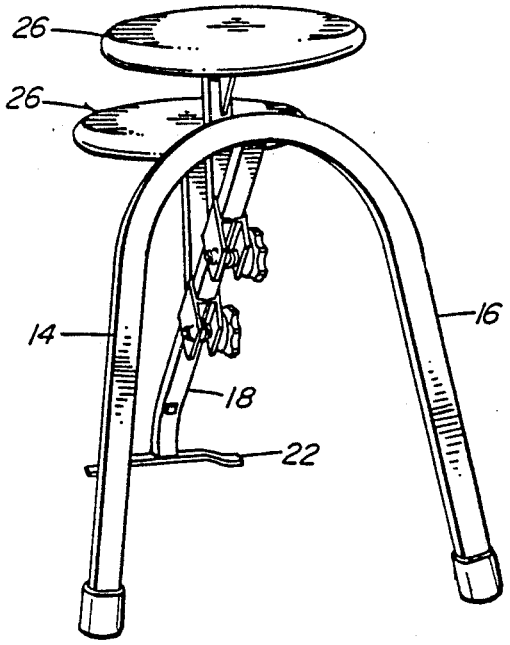
FIG. 2 is a perspective view of the invention from the rear thereof.
Figure 3:
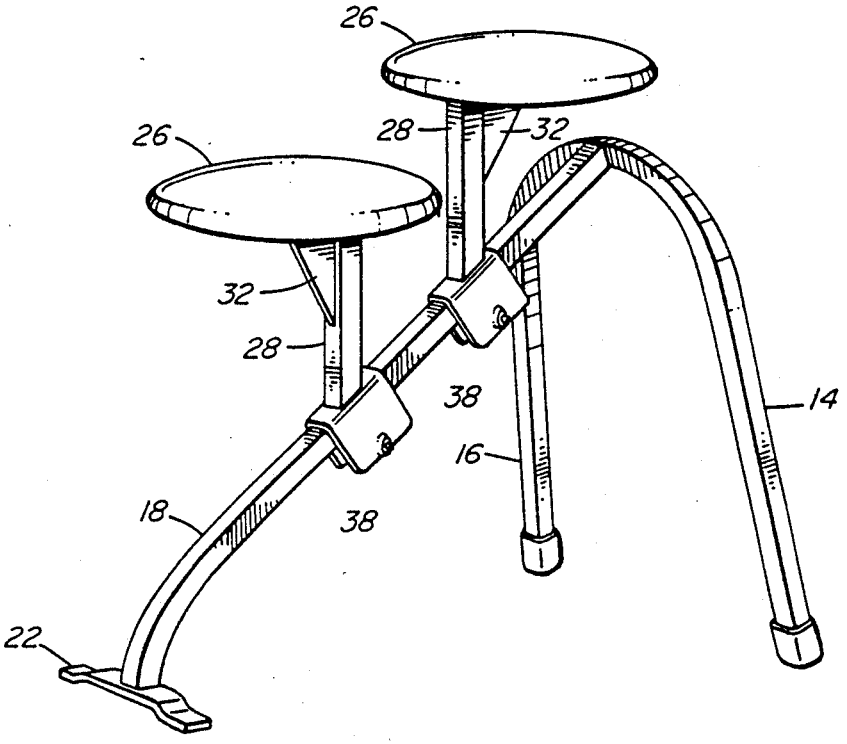
FIG. 3 is a perspective view from the side thereof.

Referring to FIGS. 1–3, the studio stool illustrated generally at 10 comprises a triangulated support structure in the form of an inverted U-shaped portion 12 providing a spaced, slightly outwardly flared legs 14 and 15. An elongated, angularly disposed support member 18 constitutes the third leg and this member is connected to and extends downwardly from the upper portion 20 of the U-shaped structure 12 and terminates, at its othre end, in a broad foot 22 adapted to rest on a supporting surface.

In the embodiment illustrated, a pair of seats are adjustably located on the support member 18 but, as mentioned earlier, the apparatus can be used with one seat or even with more that two seats if the length of the support structure 18 warrants it. In any case, the seats 24 each consist of a platform 26 mounted on a vertically oriented support post 28 and may include a metal base member 30 secured to the post 28 by reinforcing plate 32.

The lower end of the posts 28 are welded to means for releasably securing the seats on the support member. Two forms of seats securing means are illustrated, one in FIG. 4 and one in FIG. 5.

Figure 4:
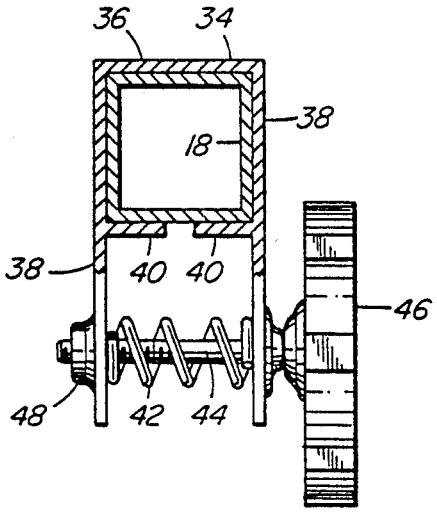
FIG. 4 is a cross-sectional view taken along the line 4—4 in FIG. 1.

Looking firstly at the arrangement in FIG. 4, a rectangular saddle 34 has an upper plate 36 to which the post 28 is welded elongated side plates 38 and a pair of inwardly directed lower plates 40. The side plates 38 extend downwardly below the support member 18 to lie in spaced relation and are biased away from one another by a suitable spring means 42. A shaft 44 having a handle 46 at one end passes through the plates 38 and spring 42 and is threadably engaged at its other end in a captive nut 48. It will be appreciated that rotating the knob 46 and turning the shaft 44 serves to tighten the plates 38 to compress the spring 42 and draw the side plates 38 towards one another so as to tighten the saddle 34 and therefor its associated seat 24 on the support member 18.

Figure 5:
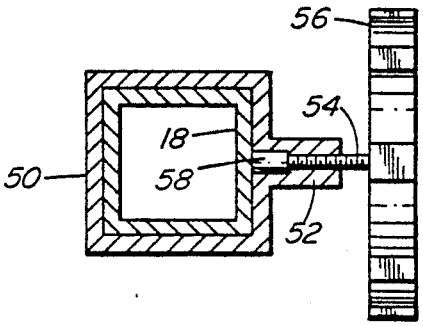
FIG. 5 is a view similar to FIG. 4 but showing an alternate arrangement thereof.

In the arrangement shown in FIG. 5, the seat securing means consists of a rectangular, tubular collar 50 that is welded to the seat post 28 and which substantially surrounds the outer surface of the support member 18 and it has a sliding fit thereon. The collar 50 includes a boss 52 which is internally threaded to receive an externally threaded shaft 54 on which a knob 56 is provided. A nylon insert 58, or the equivalent, is freely mounted inside the boss 52 and bears against the outside of the support member 18. It will be appreciated that rotating the knob 56 serves to rotate the shaft 54 and to force the insert 58 into engagement with the outside surface of the support member 18 and at the same time draw the plates of the collar 50 towards the boss 52 thereby tightening the seat on the support member 18.

The seats can be quickly arranged at various elevations for whatever purpose is desired by the photographer.

While the invention has been described in connection with a specific embodiment thereof and in a specific use, various modifications thereof will occur to those skilled in the art without departing fromt he spirit and scope of the invention as set forth in the appended claims.

The terms and expressions which have been employed in this specification are used as terms of description and not of limitation, and thereis no intention in the use of such terms of expressions to exclude any equivalents of the features shown and described or portions thereof, but it is recognized that various modifications are possible within the scope of the invention claimed.

The embodiments of the invention in which an exclusive right or privilege is claimed are defined as follows:

1. A photographer's studio stool, comprising a support structure including a pair of leg members formed in a generally inverted U-shaped arrangement and an elongated, angularly disposed support member constituting a third leg and connected to and extending downwardly from an upper portion of said inverted U-shaped arrangement to rest on a supporting surface;

at least one seat releasably secured on said elongated seat member so as to be selectively located at any desired elevation thereon, said seat comprising a platform and a vertically oriented post; and seat securing means for securing said seat onto said support member, said seat securing means comprising a rectangular saddle welded to the lower end of said post and slidably fitted over the support member, a pair of side plates on said saddle extending downwardly below said support member; spring means between said plates urging them apart to loosen said saddle on said support; and tigthtening means for drawing said plates toward one another, against said spring means, to tighten said saddle on said support.

2. A studio stool according to claim 1 wherein said third leg and support structure are fabricated from square section tubing.

3. A studio stool according to claim 1 wherein each said seat is adjustable to different locations along said support member and each seat comprises a platform and a vertically oriented post, the seat securing means mounting said post onto said support member.

4. A studio stool according to claim 3 wherein said seat securing means comprises a rectangular collar welded to the lower end of said post and slidably fitted over said support member and screw means for increasing frictional engagement between said collar and said support member.

* * * * *